United States Patent [19]

Sekiwa et al.

[11] 4,288,258

[45] Sep. 8, 1981

[54] METHOD FOR COOLING A METAL STRIP DURING THE PROCESS OF HEAT TREATMENT

[75] Inventors: Seiichiro Sekiwa, Aichi; Kenji Kawate; Hidenobu Jinnouchi, both of Nagoya, all of Japan

[73] Assignee: Daidotokushuko, Japan

[21] Appl. No.: 63,509

[22] Filed: Aug. 3, 1979

[30] Foreign Application Priority Data

Aug. 6, 1978 [JP] Japan ..... 53-95625

[51] Int. Cl.[3] ..... C21D 9/52; C22F 1/00

[52] U.S. Cl. ..... 148/13; 148/156; 148/157

[58] Field of Search ..... 148/13, 153, 156, 157

[56] References Cited

U.S. PATENT DOCUMENTS 1,948,173 2/1934 Hagan ..... 148/13

*Primary Examiner*—R. Dean

*Attorney, Agent, or Firm*—William A. Drucker

[57] ABSTRACT

During the process in which a metal strip is moved in a floating condition, the metal strip is first heated, and thereafter cooled and annealed. In cooling the metal strip, the metal strip is cooled so that both edges widthwise thereof are lowered in temperature more quickly than the temperature of a central portion widthwise thereof. The metal strip is cooled in a manner as described whereby a great thermal stress is not introduced in the metal strip and consequently, the metal strip is cooled without being wrinkled.

5 Claims, 8 Drawing Figures

METHOD FOR COOLING A METAL STRIP DURING THE PROCESS OF HEAT TREATMENT

BACKGROUND OF THE INVENTION

1. Field of the Invention

This invention relates to a method for cooling materials of low elastic limit such as aluminum strips, copper strips, and iron strips heated for the annealing.

2. Description of the Prior Arts

In prior arts, in the case where a metal strip (The term "metal strip" as used herein indicates a thin and lengthy band-like metal plate continuously rolled by a rolling mill. The thickness of the metal strip is normally less than 3.5 mm, and the plate has various widths.) is subject to cooling after it has been heated for heat treatment, even if the metal strip whose temperature has already decreased to a level below a definite value is cooled at a large temperature gradient, large thermal stresses are not introduced to the strip. However, when the temperature of the strip is not yet decreased to a level as noted above, cooling of the strip at a large temperature gradient produces large thermal stresses in the metal strip as shown by the broken lines in FIG. 5. When such large stresses occur, the stresses overcome the antibuckling stress of the metal strip and consequently give rise to wrinkles, in the metal strip, parallel to the moving direction thereof as shown in FIG. 7, resulting in a defective metal strip.

SUMMARY OF THE INVENTION

It is therefore an object of the present invention to provide a cooling method which in cooling a heated metal strip, can minimize a stress produced in the metal strip.

That is, in the method of the present invention, when a metal strip is cooled, cooling is effected by controlling the temperature in such a manner that both edges of the metal strip are lower in temperature than a central portion thereof, and as a result, less thermal stresses are introduced in the metal strip. Thus, the metal strip can be finished into a product of good quality without wrinkles.

BRIEF DESCRIPTION OF THE DRAWINGS

FIG. 2—2 is a sectional view showing an embodiment in which the plenum chamber is differently divided;

DESCRIPTION OF THE PREFERRED EMBODIMENTS

Figure 1:
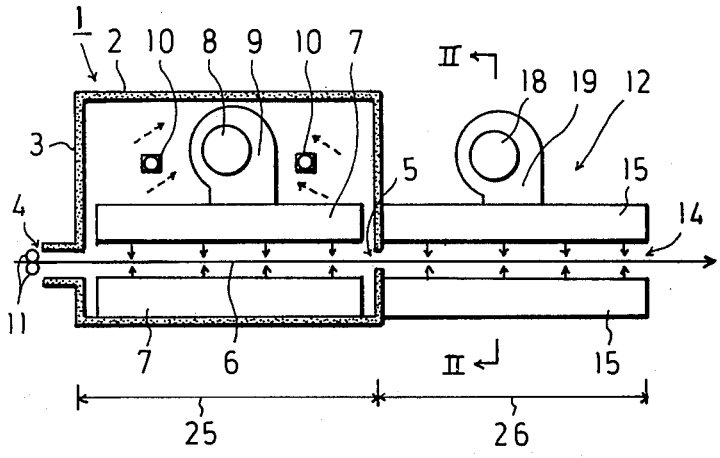
FIG. 1 is a schematic longitudinal sectional view of a heat treatment apparatus.

Referring now to FIG. 1, heat treatment apparatus 1 consists of a heating apparatus 2 and a cooling apparatus 12. First, the heating apparatus 2 will be explained. As is known, a furnace wall 3 is designed so as to form a heat shielding between the interior and exterior thereof. The furnace wall 3 has a part formed with an entrance port 4 and a reception port 5. A metal strip 6 is inserted through the entrance port 4 and reception port 5 as shown. The furnace wall 3 has plenum chambers 7 and 7 provided in a space interiorly thereof. These plenum chambers 7 and 7 are disposed opposedly in a position through which the metal strip 6 passes, and the plenum chambers 7 and 7 have their surfaces opposed to each other provided with a plurality of gas blowing nozzles in a known manner. A recirculation fan 8 is mounted on the furnace wall 3. One end of a conduit 9 is communicated with the recirculation fan 8 and the other end thereof is communicated with the plenum chamber 7. The furnace wall 3 is further internally provided with burners 10. Entrance rolls 11 are disposed frontwardly of the entrance port 4. The entrance rolls 11 are provided to steadily guide the metal strip 6 towards the entrance port 4. It is noted that the plenum chambers 7, conduit 9 and the like in the heating apparatus 2 are designed substantially equally to those members as used in the cooling apparatus, which will be described hereinafter.

Figure 2:
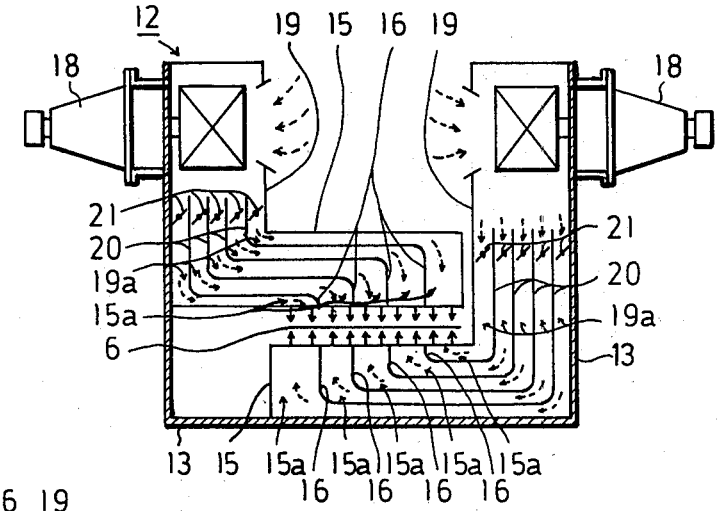
FIG. 2 is a sectional view on a larger scale taken along the line II—II of FIG. 1.
Figure 2:
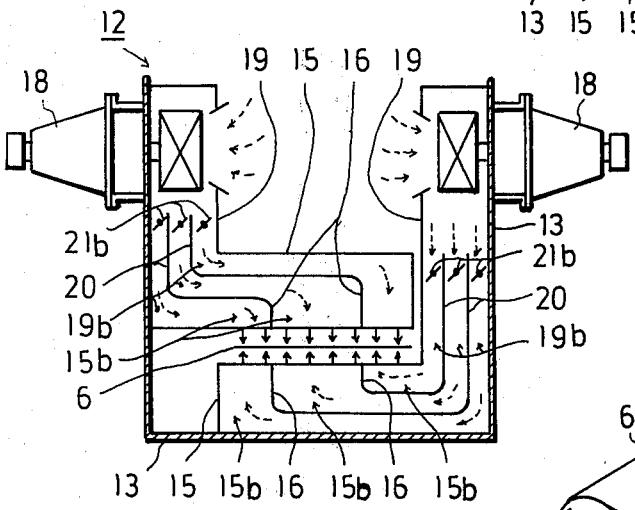

Next, the cooling apparatus 12 will be explained. The details of the cooling apparatus 12 are shown in FIG. 2. Plenum chambers 15 and 15 are disposed within a frame 13 formed of a metal material. These plenum chambers 15 and 15 are disposed opposedly in a position through which the metal strip 6 passes. These plenum chambers have their surfaces opposed to each other provided with a plurality of gas blowing nozzles in a known manner. The plenum chamber 15 is partitioned plurally widthwise of the metal strip 6 by means of partitioning walls 16, 16 . . . and divided into a plurality of chamber elements 15*a*, 15*a*, . . . as shown.

An air blower 18 is mounted on the frame 13. One end of the conduit 19 is communicated with the air blower 18 and the other end thereof is communicated with the plenum chamber 15. The conduit 19 is interiorly partitioned by partitioning walls 20, 20 . . . and divided into a plurality of conduit elements 19*a*, 19*a* . . . The partitioning walls 20, 20 . . . are individually continuous to the partitioning walls 16, 16 . . . of the plenum chamber 15 whereas the conduit elements 19*a*, 19*a* . . . are individually communicated with the chamber elements 15, 15*a* . . . The conduit elements 19*a*, 19*a* . . . are respectively provided with dampers 21, 21 . . . which control the quantity of air.

While the number of divisions widthwise of the plenum chamber 15 is five in the illustrated embodiment, it should be understood that a suitable number may be employed as occasion calls. The same is true for the number of divisions of the conduit.

Figure 3:
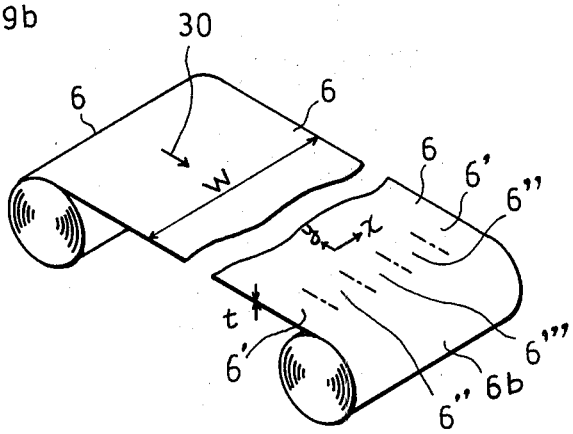
FIG. 3 is a schematic perspective view showing a state wherein the metal strip is paid off and rewound.

Next, the operation of the apparatus will be described. A metal strip 6*a* wound as shown in FIG. 3 about a pay-off reel in a known manner is paid off as shown by the arrow 30. After the thus paid off metal strip 6 has been passed through various known devices, it is inserted through the above-mentioned heat treatment apparatus. The metal strip 6 issued from the heat treatment apparatus 1 passes through various known devices and thereafter, it is rewound about a rewind reel as shown at 6*b* in a known manner.

In a state wherein the metal strip 6 is inserted through the heat treatment apparatus as described above, the burner 10, and air blowers 8, 18 are operated. In the steady condition, the metal strip 6 between the plenum chambers 7, 7 and between chambers 15, 15 is held in a floating condition by hot gases (normal air not heated in the chamber 15) blown through the nozzles on said chambers. It will be noted that the air blowers, chambers and the like in the heating apparatus 2 and cooling apparatus 12 are designed so as to perform the aforementioned function and to increase and decrease temperatures of the metal strip 6 as will be described later.

The metal strip 6 passing through the heat treatment apparatus 1 while maintaining a floating condition as described above is heated by the heating apparatus 2 and then cooled by the cooling apparatus 12. In FIG. 1, a heating zone and a cooling zone are respectively designated at 25 and 26.

Figure 4:
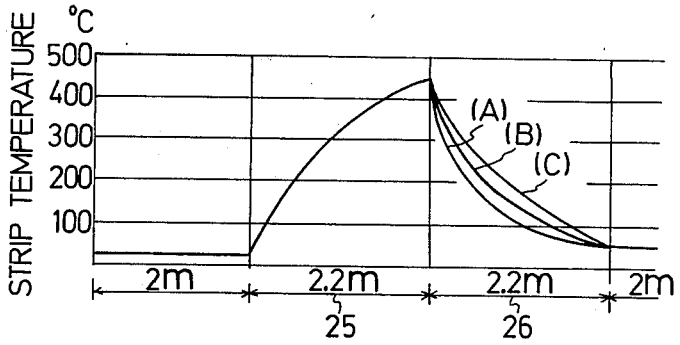
FIG. 4 is a graphic representation showing changes in temperature of an aluminum strip.

In the heat treatment of an aluminum strip as one example of the metal strip 6, one example of changes in temperature of the aluminum strip is shown in FIG. 4.

In the heating zone 25, the whole width of the aluminum strip 6 is heated at uniform temperature gradient. In the cooling zone 26, on the other hand, the aluminum strip 6 is cooled in a manner such that both edges 6' are lowered in temperature most quickly as shown at (A), a central portion 6''' is lowered in temperature most gently as shown at (C), and intermediate portions 6'' therebetween are lowered in temperature at an about intermediate rate between the aforesaid (A) and (C) as shown at (B). This can be accomplished by adjusting openings of the plurality of dampers 21. That is, the adjustment of respective openings of the dampers 21 causes to decrease the quantity of air blown from the chamber element 15*a* opposed to the central portion widthwise of the strip, to increase the quantity of air blown from the chamber elements 15*a* and 15*a* opposed to both edges widthwise of the strip, and to make the quantity of air blown from the chamber element 15*a* opposed to the intermediate portion between the central portion and both edges of the strip nearly half. With this, the strip being cooled is lowered in temperature at both edges quickly as compared to the lowering of temperature of the central portion. The dimensions of various members are that the aluminum strip is 0.3 t×2000 W, the length of the heating zone 25 is 2.2 m, and the length of the cooling zone is 2.2 m.

Figure 5:
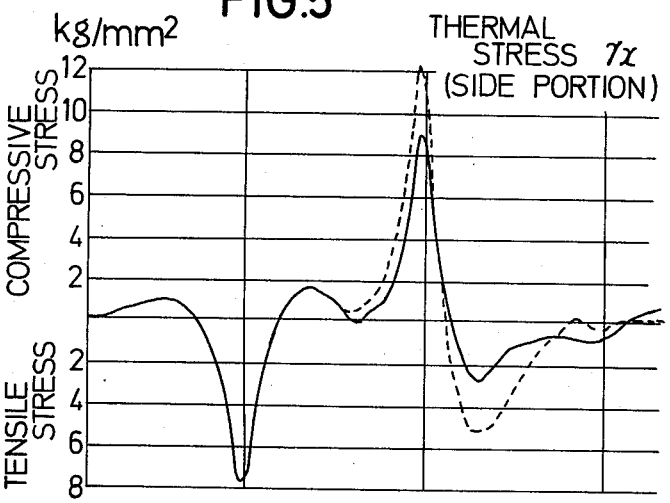
FIGS. 5 and 6 are respectively graphic representations showing thermal stresses produced in the aluminum strip.
Figure 6:
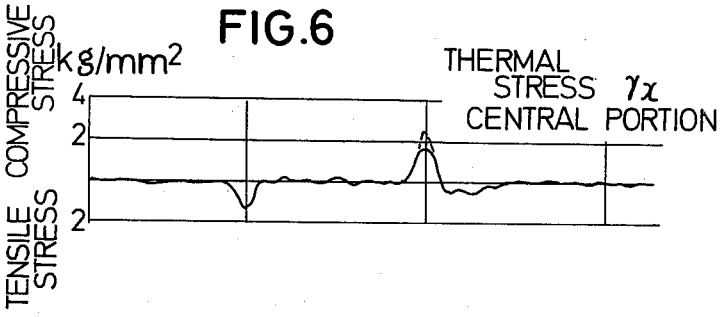
Figure 7:
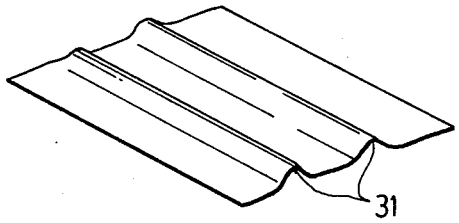
FIG. 7 is a perspective view showing a state wherein wrinkles are produced in the metal strip.

When the aluminum strip is heated and cooled as previously described, thermal stresses as shown by the solid lines in FIGS. 5 and 6 are introduced in the edge and central portion, respectively, of the aluminum strip. In FIGS. 5 and 6, thermal stresses introduced in the aluminum strip when the latter is uniformly cooled over the whole width thereof are shown by the broken lines. As can be seen from FIGS. 5 and 6, in the case the aluminum strip is cooled in the cooling zone 26 in a manner such that both edges 6' thereof are lowered in temperature quickly as compared to the central portion 6''', a small thermal stress is introduced in the aluminum strip. This small thermal stress does not generally exceed the elastic limit of the aluminum strip. Accordingly, there is not produced so large a wrinkle as to impair a value of product in the aluminum strip.

The plenum chamber 15 has been divided into five sections widthwise of the strip in the illustrated embodiment. However, it should be noted that as shown in FIG. 2—2, the plenum chamber 15 may also be divided into three chambers, i.e., chamber elements 15*b*, 15*b* and 15*b*, opposed to the central portion and both edges, respectively, of the strip. In this case, the quantity of gases (air) blown from the chamber elements 15*b* is such that the openings of respective dampers 21*b* may be adjusted to increase the quantity of air blown from the chamber elements 15*b* opposed to the both edges of the strip and to decrease the quantity of air blown from the chamber element 15*b* opposed to the central portion of the strip.

It is understood that the term "edges of the metal strip" as herein used is intended to apply to the portions other than the central portion of the metal strip. That is, the term "edges of the metal strip" indicates the portions to which the outermost chamber elements of five chamber elements shown in FIG. 2 are opposed, portions to which both outer chamber elements of three chamber elements shown in FIG. 2—2 are opposed, and the like.

What is claimed is:

1. In a method, of heat treatment of a metal strip, which includes the steps of:

(a) passing the metal strip lengthwise through a heating zone, (b) during passage of the metal strip through the heating zone, blowing hot gas onto the strip such that the strip is heated and is also maintained in floating condition by said gas, (c) upon emergence of said heated strip from said heated zone, immediately passing said heated strip lengthwise through a cooling zone, (d) during passage of the metal strip through the cooling zone, blowing cool gas onto the strip such that the strip is cooled and is also maintained in floating condition by said gas, the cooling of the metal strip being carried out with a cooling gradient which is sufficiently steep to cause in the strip, if cooled substantially equally over its width, a thermal stress greater than the anti-buckling stress of the strip, the improvement which comprises cooling the lateral longitudinal portions of the strip more rapidly than a central longitudinal portion thereof, at a rate ensuring that the thermal stress produced in the metal strip is less than the anti-buckling stress thereof.

2. The method claimed in claim 1 wherein the more rapid cooling of the lateral longitudinal portions of the strip is obtained by blowing cooling gas at a greater rate against said lateral longitudinal portions than against said central longitudinal portion.

3. The method claimed in claim 2 wherein the cooling gas is blown against the strip in three streams distributed transversely of the longitudinal direction of the strip, the two outer streams of gas being blown against lateral longitudinal portions of the strip at a rate which is greater than that of the intermediate stream blown against the central longitudinal portion of the strip.

4. The method claimed in claim 2 wherein the cooling gas is blown against the strip in five streams distributed transversely of the longitudinal direction of the strip, the two outermost streams of gas being blown against lateral longitudinal edge portions of the strip at a rate which is greater than that of the next two streams, respectively inward of the two outermost streams, blown against portions of the strip intermediate said lateral edge portions and the central portion, and the rate of said next two streams being greater than the rate of the central one of said streams blown against the central portion of the strip.

5. The method claimed in claim 4, wherein for obtaining said five streams of gas there are utilised two plenum chambers disposed respectively one above and one below the path of the strip, each plenum chamber having five conduits opening at five positions distributed transversely of the strip, the rate of blowing of the cooling gas for each stream from a respective conduit being adjusted by a respective damper in each conduit.

* * * * *

UNITED STATES PATENT AND TRADEMARK OFFICE

CERTIFICATE OF CORRECTION

PATENT NO. : 4,288,258

DATED : September 8, 1981

INVENTOR(S) : Seiichiro Sekiwa et al.

It is certified that error appears in the above—identified patent and that said Letters Patent is hereby corrected as shown below:

On the title page, Item [73] should read:

(73) Assignee: Daidotokushuko Kabushikikaisha, Japan
and
Sumitomokeikinzokukogyo Kabushikikaisha, Japan Signed and Sealed this Nineteenth Day of October 1982

[SEAL]

Attest:

GERALD J. MOSSINGHOFF

Attesting Officer

Commissioner of Patents and Trademarks